US006260521B1

(12) United States Patent
Kirschbaum

(10) Patent No.: US 6,260,521 B1
(45) Date of Patent: Jul. 17, 2001

(54) METHOD FOR CONTROLLING THE SUPPLY OF ELECTRICAL ENERGY TO AN ELECTROMAGNETIC DEVICE AND USE OF A SLIDING MODE CONTROLLER

(75) Inventor: Frank Kirschbaum, Stuttgart (DE)

(73) Assignee: DaimlerChrysler AG, Auburn Hills, MI (US)

( * ) Notice: Subject to any disclaimer, the term of this patent is extended or adjusted under 35 U.S.C. 154(b) by 0 days.

(21) Appl. No.: 09/490,822

(22) Filed: Jan. 25, 2000

(30) Foreign Application Priority Data

Jan. 25, 1999 (DE) ..... 199 02 664

(51) Int. Cl.[7] ..... F02D 41/20; F01L 9/04

(52) U.S. Cl. ..... 123/90.11; 251/129.01; 251/129.16

(58) Field of Search ..... 123/90.11; 251/129.01, 251/129.1, 129.15, 129.16

(56) References Cited

U.S. PATENT DOCUMENTS 5,298,867 * 3/1994 Mestha ..... 315/500
5,775,276 * 7/1998 Yanai et al. ..... 123/90.11
5,797,360 * 8/1998 Pischinger et al. ..... 123/90.11
5,845,490 * 12/1998 Yasui et al. ..... 60/276
5,880,952 * 3/1999 Yasui et al. ..... 364/148.01
5,983,847 * 11/1999 Miyosji et al. ..... 123/90.11
5,988,123 * 11/1999 Miyoshi et al. ..... 123/90.11
6,044,814 * 4/2000 Fuwa ..... 123/90.11
6,167,852 * 1/2001 Kamimaru et al. ..... 123/90.11

FOREIGN PATENT DOCUMENTS 02712 2/1992 (WO) .

* cited by examiner

*Primary Examiner*—Weilun Lo
(74) *Attorney, Agent, or Firm*—Mark P. Calcaterra

(57) ABSTRACT

Method for controlling the supply of electrical energy to an electromagnetic device and use of a sliding mode controller. Control devices are known in which, in order to obtain a desired movement of an electromagnetically activated gas exchange valve, the supply of electrical energy is controlled as a function of a measured position of the gas exchange valve. The novel method is intended to optimize the control with respect to the movement forms to be obtained, the formation of noise and/or the required use of electrical energy. In a control device according to the invention, a differential signal is generated using the movement signal or a signal generated from the movement signal, and using a desired signal. The supply of electrical energy to the activating device of the gas exchange valve is controlled by means of a sliding mode controller using the differential signal.

13 Claims, 5 Drawing Sheets

METHOD FOR CONTROLLING THE SUPPLY OF ELECTRICAL ENERGY TO AN ELECTROMAGNETIC DEVICE AND USE OF A SLIDING MODE CONTROLLER

The invention relates to a method for controlling the supply of electrical energy to at least one electromagnetic device serving to activate a gas exchange valve. Furthermore, the invention relates to the use of a sliding mode controller.

WO 92-02712 discloses a control device in which a measured position value of a gas exchange valve of a combustion engine is compared with a desired position (predetermined in dependence on the operating parameters of the combustion engine). Depending on the deviation of the measured position value from the desired position, an electromagnetic device assigned to the gas exchange valve is driven in such a way that the movement profile of the gas exchange valve is approximated to the desired profile that has been determined.

The operation of combustion engines with electromagnetically activated gas exchange valves has shown that the possibilities for the open-loop or closed-loop controller devices which are known in this connection are limited for example with regard to the minimization of the (capture) velocities at the upper and lower end positions of the gas exchange valve, the minimization of the energy needed to activate the gas exchange valve, the reduction of the duration of the opening and closing movements, the realization of different movement profiles, the stabilization of the control, the minimization of the evolution of noise and/or the compensation of inaccuracies on account of production tolerances, wear or temperature influences.

The present invention is thus based on the object of proposing a control device for supplying energy to an electromagnetic device for activating a gas exchange valve by means of which the reliable approximation of predetermined opening and closing movements of the gas exchange valve and/or the fixing thereof in end positions can be realized.

SUMMARY OF THE INVENTION

The object is achieved according to the invention by means of comparison of the measured movement signal or of a signal generated from the movement signal with a desired signal by forming a differential signal. Forming a differential signal in this way is possible in a simple manner. If appropriate, the signal generated from the movement signal is, by way of example, a differentiated movement signal, a multiplicity of different methods being known from control technology for carrying out the differentiation. The differential signal is subsequently subjected to sliding mode control, by means of which the control aim, for example optimization of the movement path of the gas exchange valve, minimization of the energy supplied to the electromagnetic device, and/or minimization of noise, is possible in a simple, efficient and/or cost-effective manner.

A further proposal according to the invention is characterized by transferring knowledge about sliding mode control to the control of the supply of electrical energy to an electromagnetic device for activating a gas exchange valve. This opens up a multiplicity of new possibilities of controller configuration as well as new control strategies and control aims.

BRIEF DESCRIPTION OF THE DRAWINGS

A preferred exemplary embodiment of the apparatus according to the invention is explained in more detail below with reference to the drawing, in which.

DETAILED DESCRIPTION

Figure 1:
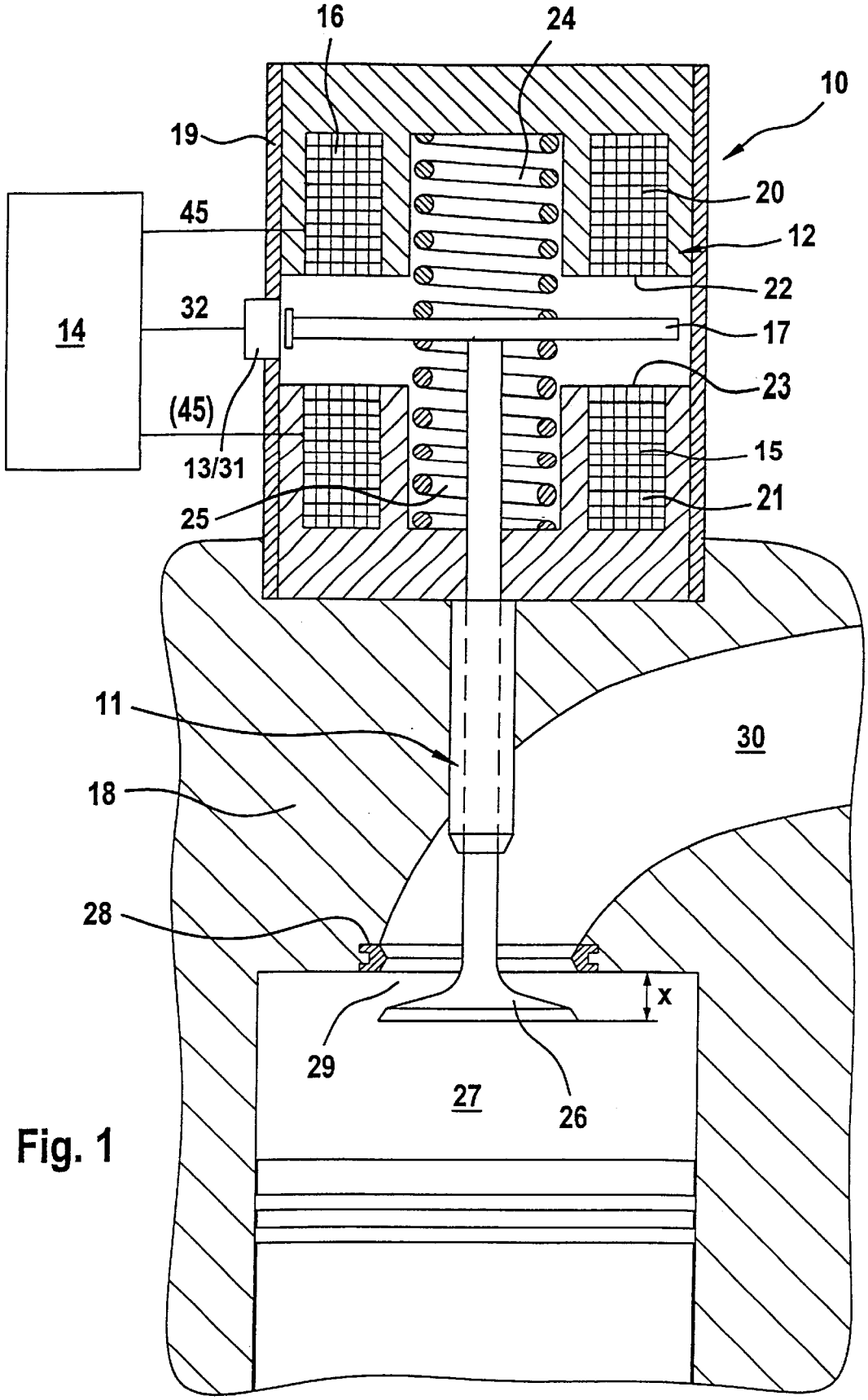
FIG. 1 shows a gas exchange valve which can be activated by an electromagnetic device.

According to FIG. 1, an activating device 10 of a gas exchange valve 11 is provided with an electromagnetic device 12, a measuring device 13 for acquiring a movement quantity, and a control device 14, to which a measurement signal from the measuring device 13 is fed and which regulates the supply of energy to the electromagnetic device 12. The electromagnetic device 12 is preferably provided with an electromagnet 15, acting as an opening magnet, and an electromagnet 16, acting as a closing magnet, which, in order to influence the movement of the gas exchange valve 11, exert forces in the longitudinal direction of the said valve on an armature 17 assigned to the gas exchange valve. The electromagnets 15, 16 are connected to one another via a housing part 19, assigned to the cylinder head 18, and each have exciter coils 20, 21 and pole faces 22, 23 facing the armature.

The force acting between the armature 17 and the pole faces 22, 23 depends on the current in the exciter coils or the voltages across the latter. The armature 17 is clamped in between two valve springs 24, 25, oriented in the axial direction of the gas exchange valve 11, in such a way that when the exciter coils 20, 21 are de-energized, the gas exchange valve 11 assumes an equilibrium position $x_G$, for example centrally between the pole faces 22, 23. When the exciter coils 20, 21 are correspondingly energized, a valve plate 26 of the gas exchange valve 11 comes to bear on a valve seat 28 (for example) in an upper end position, sealing a combustion space 27 in the process. In a lower end position, for example, corresponding to the maximum opening of the inlet and outlet opening 29 formed between the gas exchange valve 11 and the valve seat 28, the armature 17 comes to bear on the pole face 23. The outlet opening 29 connects a gas exchange duct 30 to the combustion space 27.

The explanations below are not intended to be restricted in respect of the exemplary embodiment illustrated in FIG. 1. Rather, the features essential to the invention can be used for any desired electromagnetic valve controllers of one or more inlet and/or outlet ducts of at least one combustion space. Moreover, in order to simplify the explanation, only the movement and the control of the movement of a gas exchange valve 11 after being released from the lower end position (for example open position) until reaching the upper end position (for example closed position), in other words for example the closing movement, is described below. The features according to the invention can equally be used in connection with the movement control of the opening movement or of the entire movement cycle of the gas exchange valve.

By means of a sensor 31, a movement quantity of the gas exchange valve 11 is acquired, in particular contactlessly. In the exemplary embodiment illustrated in FIGS. 1 and 7, the displacement x of the gas exchange valve is acquired. In alternative embodiments, it is possible alternatively or additionally to acquire the velocity V and/or the acceleration a. The measurement methods used may include all the known measuring methods, in particular a pressure measuring pick-up at the stationary spring base of a valve spring 24, 25, a permanent magnet moved with the gas exchange valve relative to a magnetic field sensor fixed to the housing, detection of a change in induction on account of a core moved with the gas exchange valve 11, or a laser measurement method.

Figure 2:
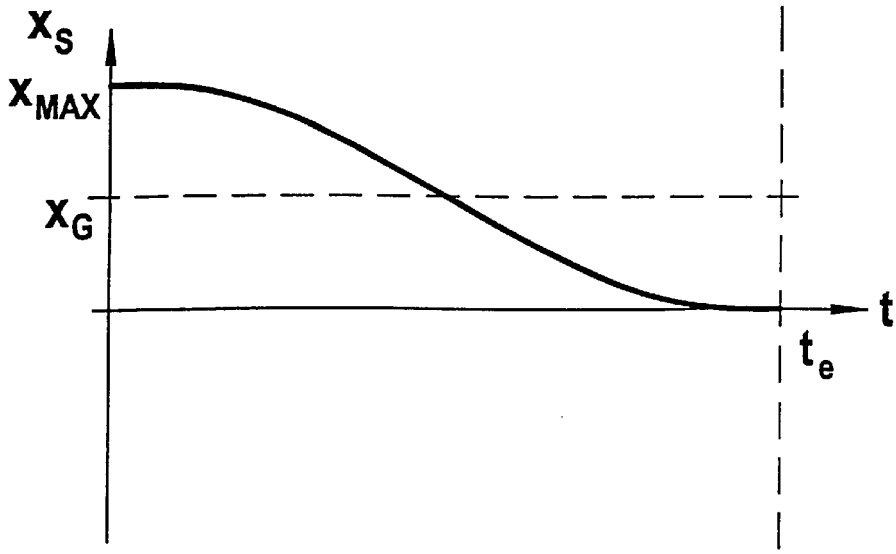
FIG. 2 shows a displacement-time signal of a subregion of the movement of the gas exchange valve.
Figure 3:
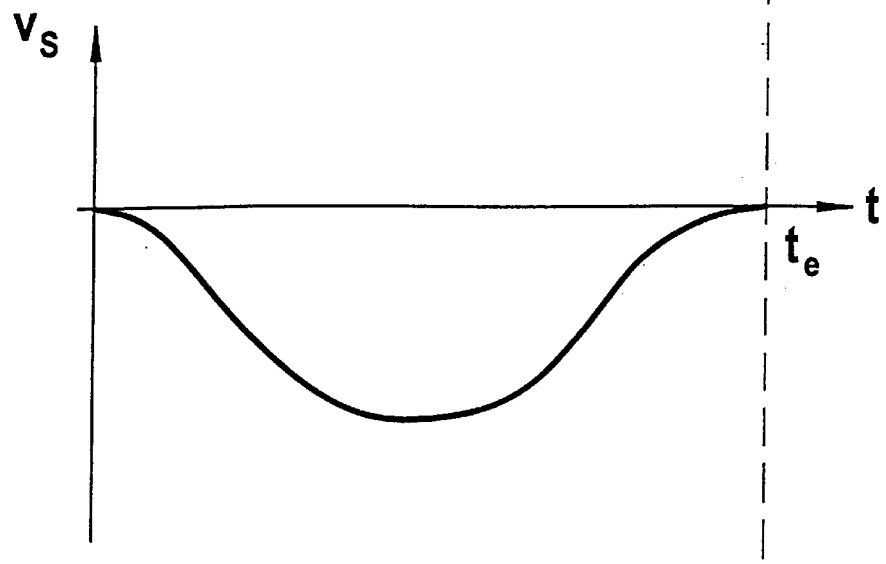
FIG. 3 shows a velocity-time signal of a subregion of the movement of the gas exchange valve (time derivative of the signal according to FIG. 2)
Figure 4:
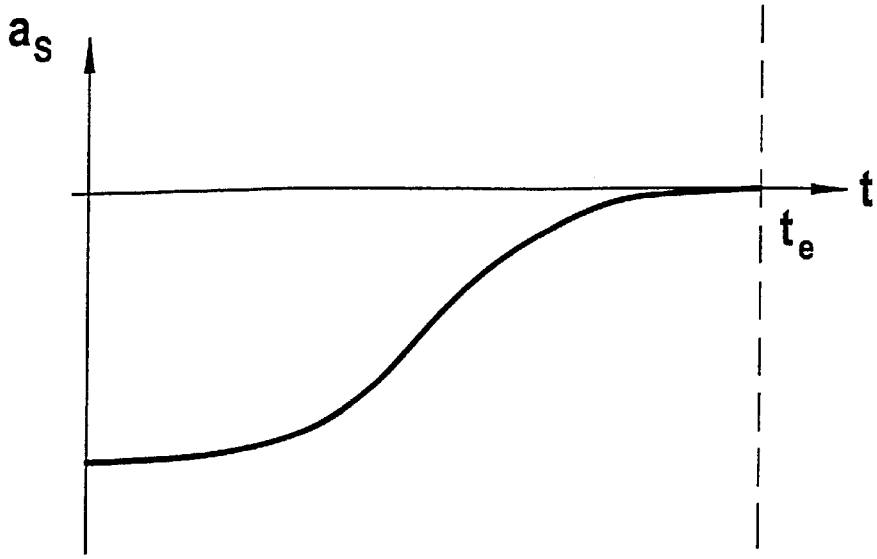
FIG. 4 shows an acceleration-time signal of a subregion of the movement of the gas exchange valve (time derivative of the signal according to FIG. 3)
Figure 5:
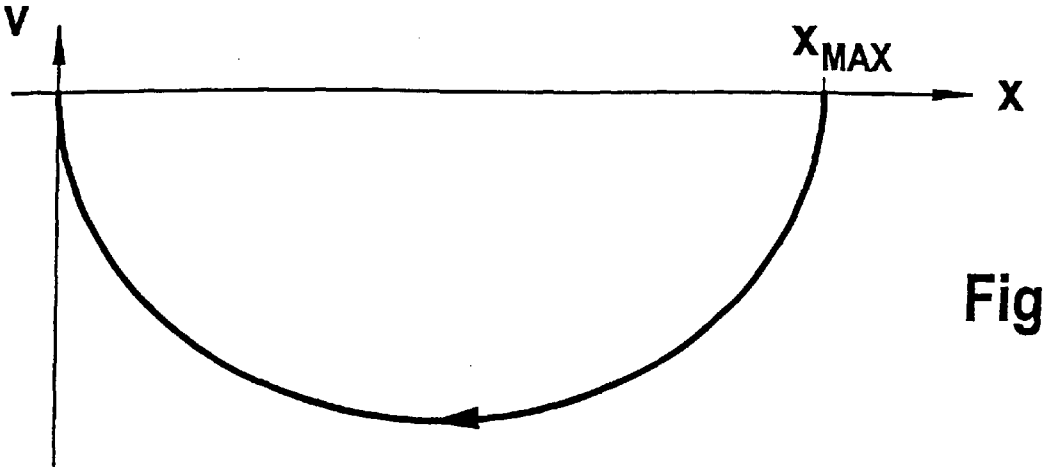
FIG. 5 shows an illustration of a subregion of the movement of the gas exchange valve in the phase plane (velocity as a function of the displacement)
Figure 6:
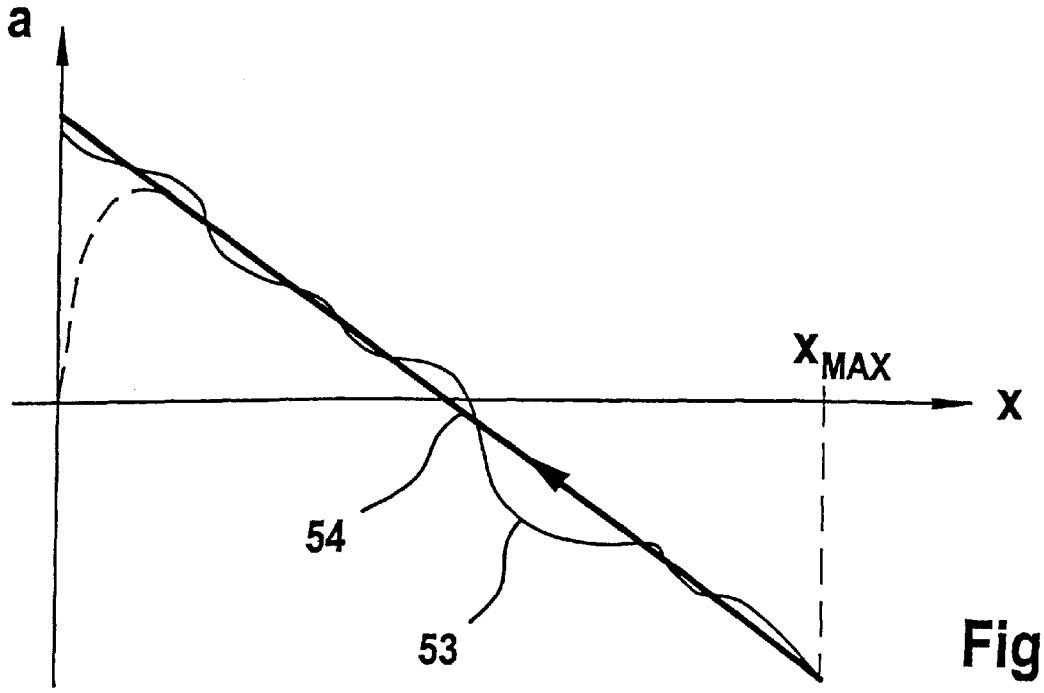
FIG. 6 shows an illustration of a subregion of the movement and of two different desired movements of the gas exchange valve with the acceleration as a function of the displacement.

The desired profile of the displacement x of the gas exchange valve as illustrated in FIG. 2 is a harmonic function, namely $x_S(t)=A \cos \omega t+x_G$, where the gas exchange valve starts in the lower end position for t=0 and reaches the upper end position for $t_E$. The resulting desired profile for the velocity $V_S$ (acceleration $a_S$) is, in accordance with FIG. 3 (FIG. 4), the velocity $v_S(t)=-A\omega \sin \omega t$ (the acceleration $a_S(t)=-A\omega^2 \cos \omega t$). FIG. 5 shows the illustration of the desired signal in the phase plane, that is to say the velocity $v_S$ as a function of the displacement $x_S$. FIG. 6 illustrates the acceleration $a_S$ as a function of the displacement $x_S$. In the case of the displacement signal assumed to be a harmonic function according to FIG. 2, the acceleration as is linearly dependent on the displacement $x_S$, the acceleration amounting to zero at the instant of passing through the equilibrium position $x_G$.

In the undamped and undisturbed case, that is to say for example without disturbing gas forces or friction influences, the desired profiles illustrated are produced without actuating forces of the electromagnetic device 12 for linear valve springs 24, 25, for which desired profiles the upper end position is reached (ideally) without any shocks with $v(t_E=0)$. For operation with the gas exchange valve exposed to disturbing forces, in particular friction, damping and gas forces or nonlinearities of the valve springs 24, 25, control forces have to be applied by means of the electromagnetic device 12 for the purpose of approximation to the desired signals FIG. 2 to FIG. 6.

Furthermore, control forces have to be applied in order to obtain desired profiles which are designed to deviate from FIGS. 2 to 6, result from the operating conditions, for example, and can be adapted thereto. Relevant operating parameters are, for example, the load range, engine speed, engine temperatures or gas temperatures.

The straight line 53 in FIG. 6 corresponds to the desired signal of the acceleration for obtaining the harmonic movement. The desired curve 54 is an alternative movement form for which the gas exchange valve 11 approaches the upper end position without acceleration. A further possible desired curve is a Gaussian function for the velocity profile. The curve profiles that have been mentioned are not intended to mean a restriction in respect of the waveforms that can be used. If one profile of a movement profile is stipulated, the remaining movement profiles result (in accordance with FIGS. 2 to 6) from the known conformities to laws.

Figure 7:
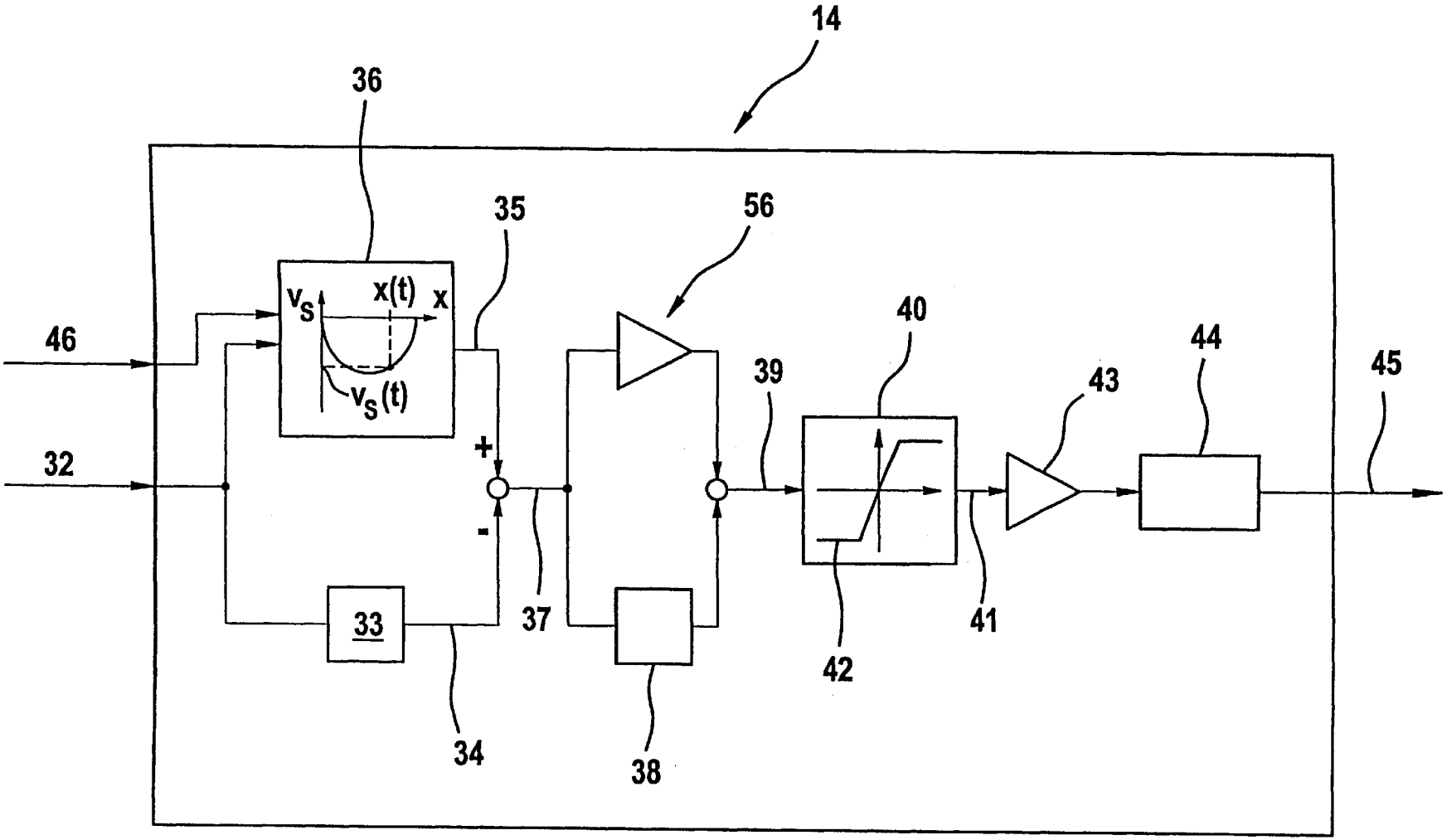
FIG. 7 shows a block diagram of a control device.

A control strategy according to the invention is illustrated in FIG. 7. The input variable of the control device 14 is the measurement signal 32 from the measuring device 13, the displacement x in the embodiment illustrated in FIG. 7. An approximation of the velocity v (signal 34) is determined from the measurement signal 32 by means of a differentiator 33. The desired velocity vs (signal 35) can be determined from the measured displacement x (signal 32) by means of an element 36. The differential signal 37 of the deviation Δv of the velocity v from the desired velocity $v_S$ is produced by way of $\Delta v=v_S-v$. The differential signal 37 is fed to a controller unit 56. The controller unit has a differentiator 38, at the output of which the amplified differential signal 37 is added to the signal $\Delta\tilde{a}$, thereby resulting in an approximated differential acceleration 39 where $\Delta a=\Delta\tilde{a}+K\,\Delta v$. The differential acceleration 39 is thus generated from the differential signal 37 by means of a PD element. The differential acceleration 39 is applied to a control block 40, whose output signal 41 is generated from the differential acceleration 39 by means of a control function 42. The signal 45 that is fed to the electromagnetic device 12, in particular the current of the exciter coil 20 or 21, is generated from the output signal 41 by means of a P element 43 and an output stage 44.

In the exemplary embodiment illustrated, the control function 42 is a (smoothed) signum function which is used to generate signals 45 which have identical magnitudes, but correspond to the sign of the differential acceleration 39, outside the smoothing range of the signum function. As an alternative, it is conceivable to generate a signal 45 identical to zero by corresponding zero shifting of the ordinate of the control function 42 for one sign of the differential acceleration 39 and to output a defined value for the other sign of the differential acceleration, with the result that the control unit 14 controls the signal 45 between two discrete valves. Adaptation of the signal 45 to different magnitudes of the differential acceleration 39 can be obtained by the P element 43 having a gain which is dependent on a movement quantity, in particular the differential acceleration.

In the element 36, the desired velocity is determined by way of a phase curve which is stored in tabular form, in the form of a characteristic family or by means of mathematical modelling. In this case, it is possible to store and use different desired value profiles in dependence on measured operating parameters 46. Relevant operating parameters are, for example, the crank angle, the engine speed, the engine load, engine temperature, the gas pressure or gas temperatures. The desired value profiles can be generated in accordance with the modelling by means of a microprocessor; in particular, adaptation to the operating parameters takes place during operation of the combustion engine. This is possible, for example, for mathematical modelling by means of parameters of the mathematical modelling which are dependent on the operating parameters.

Known blocks for the determination (of an approximation) of the time derivative of a signal, for example a D element or Kalmann filtering, can be used as differentiators 33, 38.

Further control functions 42 can be selected according to selection methods and criteria which are known for sliding mode controllers. In order to stabilize the control or stabilize the movement around the desired movement, it is necessary that a Ljapunov stability criterion be fulfilled by the control function chosen. Given such a selection of the control function, the actual curve 55 of the acceleration remains in direct proximity to the desired curve 54, cf. FIG. 6.

Figure 8:
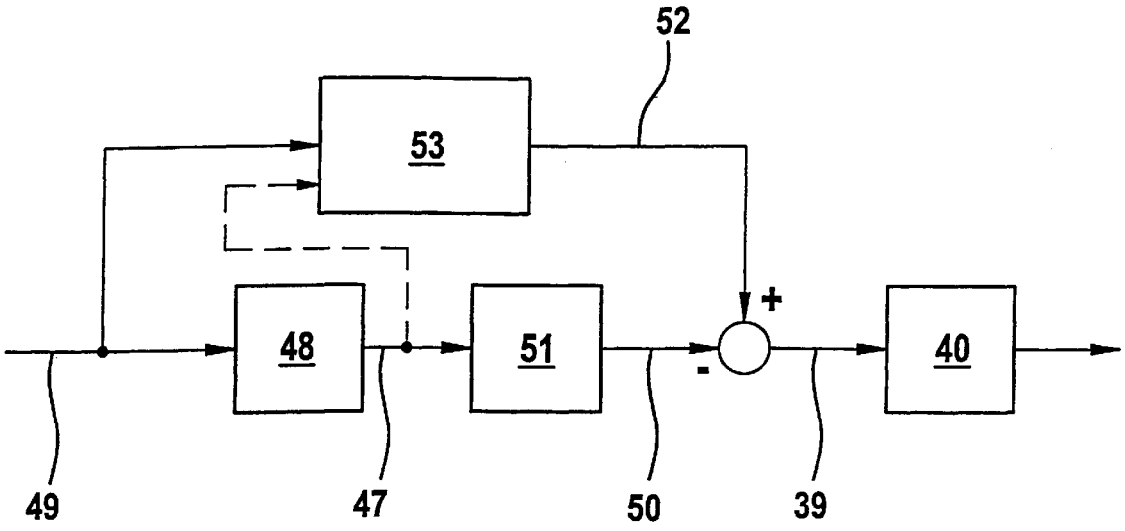
FIG. 8 shows an alternative embodiment of a subregion of the control device according to FIG. 7.

In a departure from the block diagram illustrated in FIG. 7, the method according to the invention and the use according to the invention can be designed as follows (unless mentioned otherwise, the signal processing is effected for example in accordance with the description referring to FIG. 7):

According to the exemplary embodiment in FIG. 8 with signal routing as shown by the solid lines, a determination (of an approximation) of the velocity signal 47 is effected by a measured displacement signal 49 being applied to a differentiator 48. An approximation of the acceleration signal 50 is determined by means of a differentiator 51. The desired signal of the acceleration 52 is determined by means of an element 53, to which the measured displacement signal 49 is fed as an input signal, in which, for example, the desired profile of the acceleration 52 as a function of the displacement 49 in accordance with FIG. 6 is stored in tabular form or, in the case of a linear dependence, multiplication of the displacement signal 49 by a constant and with the addition of a further constant is effected. The subtraction of the approximate value of the acceleration signal 50 from the desired value of the acceleration 52 results in a differential acceleration 39 which is processed further in an analogous manner to the differential acceleration 39 in FIG. 7.

As an alternative, as shown by the dashed line in FIG. 8, it is possible to feed the approximation signal of the velocity, instead of the displacement signal, to the element 53 if the dependence of the acceleration on the velocity can be mapped by means of the element 53.

The determination of the two time derivatives by means of the differentiators 48, 51 can also be effected by means of one block, in particular by means of a Wiener filter.

If the velocity is measured directly by a suitable measurement sensor, the measurement signal can be fed directly as signal 47, so that the differentiator 48 is not necessary.

In the case of direct measurement of the acceleration and also of the time since the beginning of the movement operation, for example the release of the armature from the lower end position, the desired value of the acceleration that is necessary for determining the differential acceleration can be generated by means of an element which maps the desired acceleration as a function of the time that has elapsed since the beginning of the movement.

In order to realize a holding force, the control strategy can be changed when the displacement x of the upper or lower end region (or of a tolerance region around these) is reached. By way of example, at this point in time until the gas exchange valve 11 is released again, a constant holding current may be output by the control device.

What is claimed is:

1. Method for controlling the supply of electrical energy to at least one electromagnetic device serving to activate a gas exchange valve in combustion engines with a measuring device for determining a movement signal of the gas exchange valve and a control device, to which the movement signal is fed on the input side and by means of which an actuating signal is generated as a function of the result of the comparison of the movement signal or of a signal generated from the movement signal with a desired signal, which actuating signal is fed to the electromagnetic device on the output side, via an output stage, characterized in that, in the control device, a differential signal is generated using the movement signal or a signal generated from the movement signal and using a desired signal, and the actuating signal is determined by means of a sliding mode controller using the differential signal.

2. Method according to claim 1, characterized in that at least one determination of a time derivative or of an approximation thereof of the movement signal or of the differential signal is determined in the control device.

3. Method according to claim 1, characterized in that the desired signal is dependent on operating parameters of the combustion engine.

4. Method according to claim 1, characterized in that the differential signal is processed in accordance with a control function in the control device.

5. Method according to claim 4, characterized in that a signum function is used as the control function.

6. Method according to claim 1, characterized in that a) a displacement signal is determined as the movement signal, b) at least one approximation of a velocity signal is determined from the displacement signal, c) the differential signal is determined from the approximation of the velocity signal and the desired signal, d) the differential signal is fed to a controller unit having at least one D component, e) the output signal of the controller unit is processed in an element in accordance with a control function, f) depending on the output signal of the control function, an electrical signal that is fed to the electromagnetic device is determined.

7. Method according to claim 6, characterized in that the controller unit is a PD element.

8. Method according to claim 1, characterized in that an output stage is connected downstream of the controller unit.

9. Method according to claim 1, characterized in that an amplifier with a gain which is dependent on the differential signal or a derivative thereof is connected downstream of the controller unit.

10. Method according to claim 1, characterized in that a desired acceleration depends linearly on the shift at least in a subregion.

11. Method according to claim 1, characterized in that the desired signal is selected from a characteristic family of desired signals, the selection being made in dependence on operating parameters of the combustion engine.

12. A method for activating an armature assigned to a gas exchanged valve comprising:

using a sliding mode controlling a supply of electrical energy to an electromagnetic device associated with the armature.

13. The method according to claim 12, characterized in that the movement profile of the gas exchange valve is approximated to a predetermined movement sequence as a control aim of the sliding mode controller.

* * * * *